US009896300B2

(12) United States Patent
Wu

(10) Patent No.: US 9,896,300 B2
(45) Date of Patent: Feb. 20, 2018

(54) COMPOSITE REELING DEVICE

(71) Applicant: Tera I-Dar Wu, Beaverton, OR (US)

(72) Inventor: Tera I-Dar Wu, Beaverton, OR (US)

( * ) Notice: Subject to any disclaimer, the term of this patent is extended or adjusted under 35 U.S.C. 154(b) by 407 days.

(21) Appl. No.: 14/847,062

(22) Filed: Sep. 8, 2015

(65) Prior Publication Data

US 2017/0066621 A1 Mar. 9, 2017

(51) Int. Cl.
*B65H 75/14* (2006.01)
*B65H 75/22* (2006.01)

(52) U.S. Cl.
CPC ..... *B65H 75/146* (2013.01); *B65H 75/22* (2013.01)

(58) Field of Classification Search
CPC ..... B65H 75/146; B65H 75/22
See application file for complete search history.

(56) References Cited

U.S. PATENT DOCUMENTS 5,934,606 A * 8/1999 Guild ..... B65H 75/146 242/603

* cited by examiner

*Primary Examiner* — William E Dondero
(74) *Attorney, Agent, or Firm* — Schmeiser, Olsen & Watts, LLP

(57) ABSTRACT

A composite reeling device for winding up and letting out cables, steel ropes and cords includes a shaft, a sleeve, two outer wheel frames and a plurality of inner wheel frames. Two fixing end plates are disposed at two opposing ends of the shaft, respectively. The sleeve is fitted around the shaft. Fixing flanges are disposed at two opposing ends of the sleeve, respectively. The fixing flanges correspond in position to the fixing end plates, respectively. The outer wheel frames are disposed at the two ends of the sleeve, respectively, and removably coupled to the fixing flanges and the fixing end plates, respectively. The inner wheel frames each have a belt, a supporting ring and spokes. The spokes each have two ends connected to corresponding ones of the belts and the supporting rings. The belts are fitted around the sleeve.

14 Claims, 7 Drawing Sheets

COMPOSITE REELING DEVICE

FIELD OF THE INVENTION

The present invention relates to composite reeling devices and more particularly to a composite reeling device for reeling cables, steel ropes, cords, etc.

BACKGROUND OF THE INVENTION

A reeling device is for use in reeling cables, steel ropes, and cords (hereinafter collectively referred to as wires) to facilitate the storage and transport thereof Referring to FIG. 1, there is shown a schematic view of a conventional reeling device.

Referring to FIG. 1, the conventional reeling device comprises an internal shaft 60, a drum 70, two outer wheel frames 80 and a plurality of inner wheel frames 90. The internal shaft 60 has two opposing ends each provided with an end plate 61. The internal shaft 60 is penetratingly disposed in the drum 70. The two outer wheel frames 80 are disposed at the two opposing ends of the drum 70, respectively. The outer wheel frames 80 each have a plurality of connection bars 81 and an outer ring 84. The connection bars 81 have welding portions 82 coupled to the end plates 61 and welding portions 83 coupled to the drum 70. The connection bars 81 are fixedly disposed inward to the outer ring 82 and arranged radially. The inner wheel frames 90 each have a supporting ring 92 and a plurality of spokes 93. The spokes 93 are fixedly disposed inward to the supporting ring 92 and arranged radially. The spokes 93 each have a welding portion 91 coupled to the drum 70. The inner wheel frames 90 are arranged between the two outer wheel frames 80 to define a plurality of spaces for receiving the wires.

However, the conventional reeling device is characterized in that the outer wheel frames 80 and the inner wheel frames 90 are coupled to the drum 70 and the internal shaft 60 by welding, and thus it is impossible to remove the outer wheel frames 80 and the inner wheel frames 90. Since there are spaces between each of the outer wheel frames 80 and two adjacent inner wheel frames 90, it is difficult to stack up the conventional reeling devices, thereby causing a waste of storage space and an increase in transport costs (because just a limited number of the conventional reeling devices can be carried by a vehicle.)

SUMMARY OF THE INVENTION

It is an objective of the present invention to provide a composite reeling device which is not only easy to use and easy to assemble but also allows its components, such as a shaft, sleeve, outer wheel frames and inner wheel frames, to be separated, stored, and stacked during a storage process or a transport process, not to mention that more said composite reeling devices can be stored in a specific storage space than their conventional counterparts.

In order to achieve the above and other objectives, the present invention provides a composite reeling device which comprises a shaft, a sleeve, two outer wheel frames and a plurality of inner wheel frames. The shaft has two opposing ends each provided with a fixing end plate. The sleeve is fitted around the shaft and has two opposing ends each provided with a fixing flange. The fixing flanges correspond in position to the fixing end plates, respectively. The two outer wheel frames are disposed at the two ends of the sleeve, respectively, and removably coupled to the fixing flanges and the fixing end plates, respectively. The inner wheel frames each comprise a belt, a supporting ring and a plurality of spokes. The spokes each have two ends connected to corresponding ones of the belts and corresponding ones of the supporting rings, such that the belts are fitted around the sleeve removably.

The composite reeling device further comprises an adjustment unit disposed at two adjacent inner wheel frames removably.

Regarding the composite reeling device, the adjustment unit comprises a plurality of rods each having two ends coupled to the spokes of two adjacent inner wheel frames removably.

Regarding the composite reeling device, a screw hole is disposed at each of the two ends of each rod, and the spokes each have a plurality of screw holes arranged lengthwise and adapted to fasten the rods, respectively.

Regarding the composite reeling device, the outer wheel frames each comprise a fixing disk, an outer ring and a plurality of connection elements, with the connection elements connected to the fixing disks and the outer rings, and the fixing disks are removably coupled to the fixing flanges and the fixing end plates.

Regarding the composite reeling device, a protruding portion and a positioning portion are disposed at the two opposing ends of the shaft, respectively, and correspond in position to the two fixing end plates, respectively, wherein the fixing disks each have a central hole and a positioning opening, wherein the protruding portions are penetratingly disposed in the central holes, respectively, and the positioning portions are engaged with the positioning openings, respectively.

Regarding the composite reeling device, the fixing flanges each have a positioning slot, and the fixing disks each have a positioning bump, wherein the positioning bumps correspond in shape and position to the positioning slots, respectively, to therefore enable engagement therebetween.

Regarding the composite reeling device, the sleeve has a positioning guiding groove extending axially from an end of the sleeve to another end of the sleeve, wherein a positioning sliding bump protrudes from each of the belts of the inner wheel frames and slides along the positioning guiding groove.

Regarding the composite reeling device, the inner wheel frames are arranged equidistantly.

Therefore, the composite reeling device has an advantage, that is, a plurality of inner wheel frames define a plurality of spaces for receiving the wires of different types to thereby enhance ease of use. The composite reeling device has some other advantages: the shaft, sleeve, outer wheel frames and inner wheel frames can be removed during a storage process and a transport process so as to be stored and stacked separately. Unlike the prior art, the present invention has important advantages as follows: storing more composite reeling devices in a space of a specific volume, increasing the storage space utilization rate, and using less vehicles required for transport. Furthermore, in this embodiment, the composite reeling device is equipped with the adjustment unit for adjusting the perimeter of the windings of the wires.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE PREFERRED EMBODIMENTS

Figure 1:
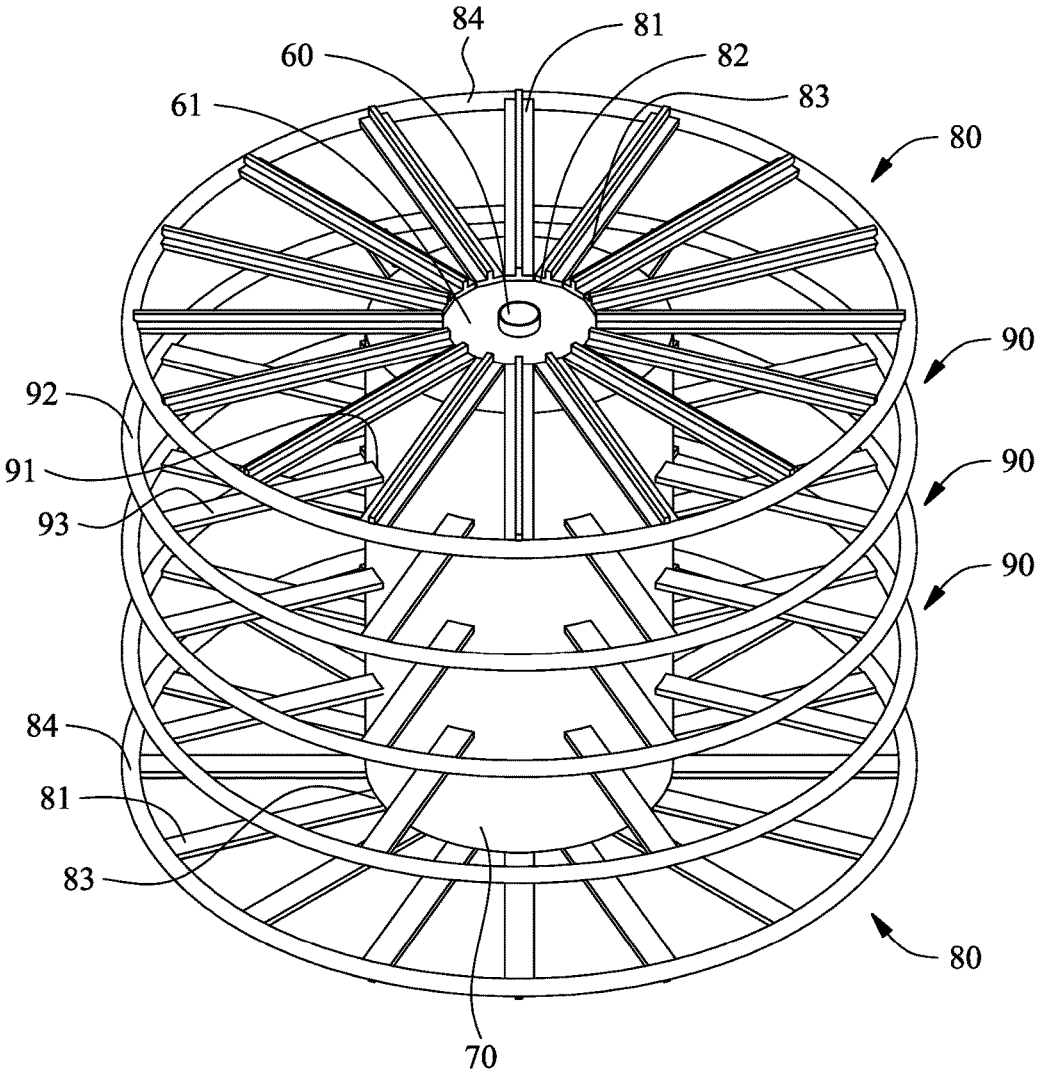
FIG. 1 (PRIOR ART)
FIG. 1 (PRIOR ART) is a schematic view of a conventional reeling device.
Figure 2:
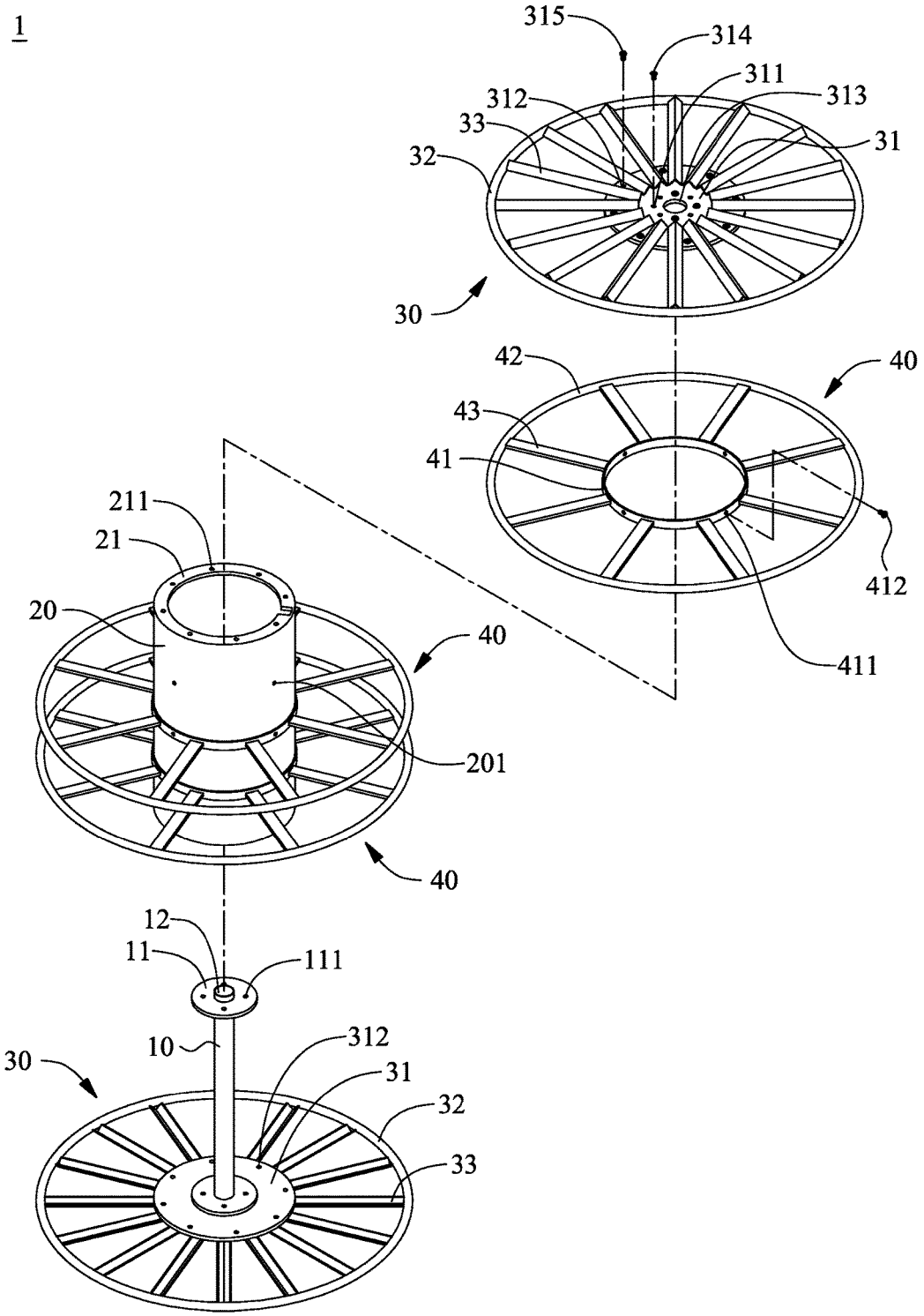
FIG. 2 is an exploded view of a composite reeling device according to an embodiment of the present invention.

According to an embodiment of the present invention, a composite reeling device is for use in reeling cables, steel ropes and cords (hereinafter collectively referred to as wires) to facilitate the storage and transport thereof Referring to FIG. 2, there is shown an exploded view of a composite reeling device 1 according to an embodiment of the present invention. The composite reeling device 1 comprises a shaft 10, a sleeve 20, two outer wheel frames 30 and a plurality of inner wheel frames 40. A fixing end plate 11 is disposed at each of the two opposing ends of the shaft 10. The sleeve 20 is fitted around the shaft 10. A fixing flange 21 is disposed at each of the two opposing ends of the sleeve 20. The fixing flanges 21 correspond in position to the fixing end plates 11, respectively. The two outer wheel frames 30 are disposed at the two ends of the sleeve 20, respectively. The outer wheel frames 30 are removably coupled to the fixing flanges 21 and the fixing end plates 11, respectively. The inner wheel frames 40 each comprise a belt 41, a supporting ring 42 and a plurality of spokes 43. The two ends of each of the spokes 43 are connected to a corresponding one of the belts 41 and a corresponding one of the supporting rings 42. The belt 41 is fitted around the sleeve 20.

The outer wheel frames 30 each have a fixing disk 31, an outer ring 32 and a plurality of connection elements 33. The connection elements 33 are connected to the fixing disks 31 and the outer rings 32, respectively. In this embodiment, the connection elements 33 are rods with V-shaped cross-sections. The two ends of the connection elements 33 are fixed, by welding, for example, to the fixing disks 31 and the outer rings 32, respectively, and arranged radially and annularly.

The fixing disks 31 are removably coupled to the fixing flanges 21 and the fixing end plates 11, respectively. The fixing end plates 11 each have a plurality of first mounting holes 111. The fixing flanges 21 each have a plurality of second mounting holes 211. The fixing disks 31 each have a plurality of innermost apertures 311 corresponding in position to the first mounting holes 111 and a plurality of outermost apertures 312 corresponding in position to the second mounting holes 211, respectively. Screws 314 are penetratingly disposed at the first mounting holes 111 and the innermost apertures 311; hence, the outer wheel frames 30 are fixed to the fixing end plates 11, respectively. Screws 315 are penetratingly disposed at the second mounting holes 211 and the outermost apertures 312; hence, the outer wheel frames 30 are fixed to the fixing flanges 21, respectively.

Figure 3:
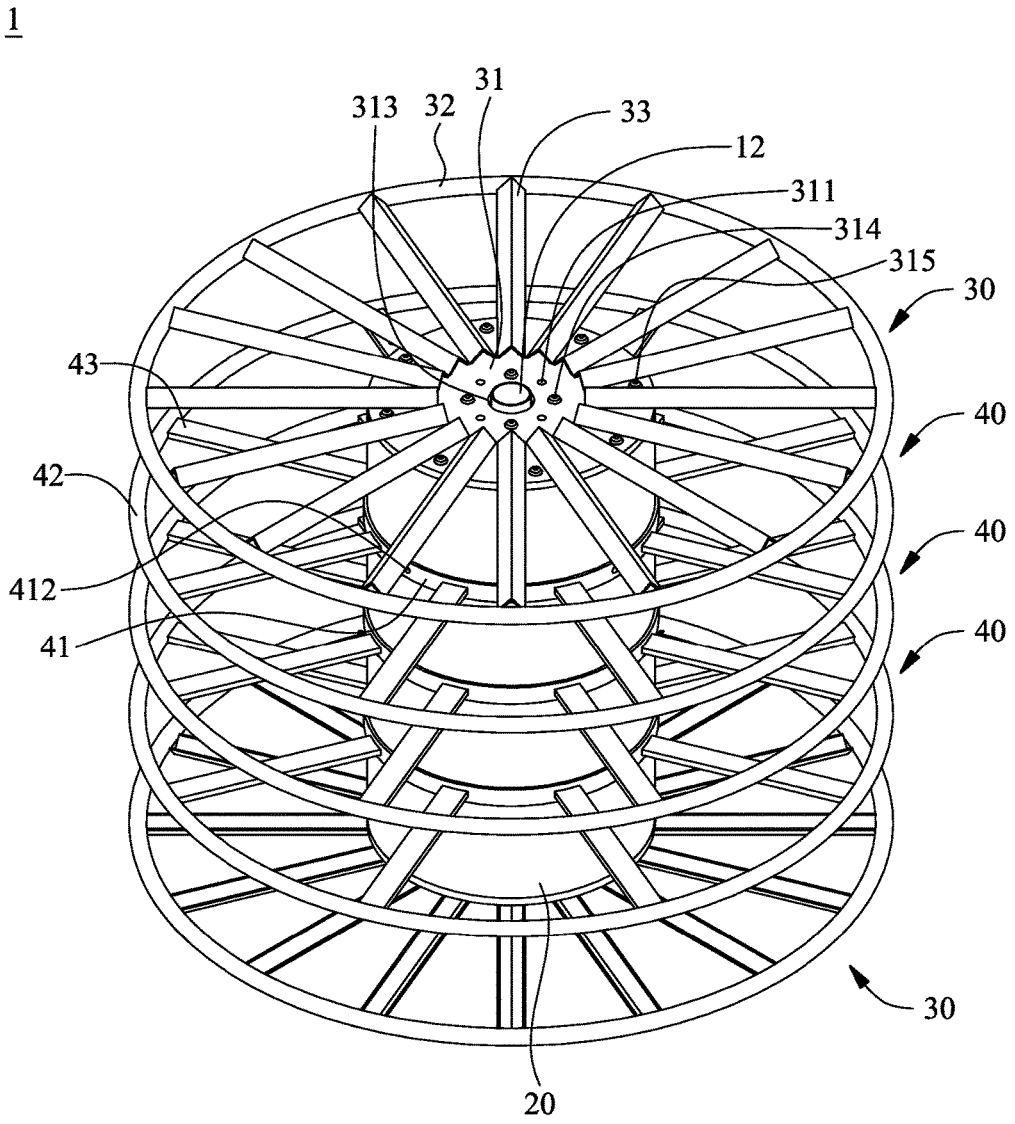
FIG. 3 is a perspective view of the composite reeling device also shown in FIG. 2 according to the embodiment of the present invention.

The sleeve 20 is cylindrical and thus is defined with an outer cylindrical surface. Wires (not shown) are wound onto the outer cylindrical surface of the sleeve 20. Referring to FIG. 3, the inner wheel frames 40 are fitted around the sleeve 20 and spaced apart, such that spaces are formed between two adjacent inner wheel frames 40 and between each outer wheel frame 30 and its neighboring inner wheel frames 40. Hence, the sleeve 20 has a plurality of spaces for receiving various wires. The inner wheel frames 40 are arranged equidistantly.

The outer cylindrical surface of the sleeve 20 has a plurality of third mounting holes 201. Mounting holes 411 are disposed on the belts 41 of the inner wheel frames 40 and correspond in position, shape and quantity to the third mounting holes 201. Screws 412 are penetratingly disposed at the third mounting holes 201 and the mounting holes 411, respectively, to allow the inner wheel frames 40 to be fixed to the sleeve 20.

Figure 4:
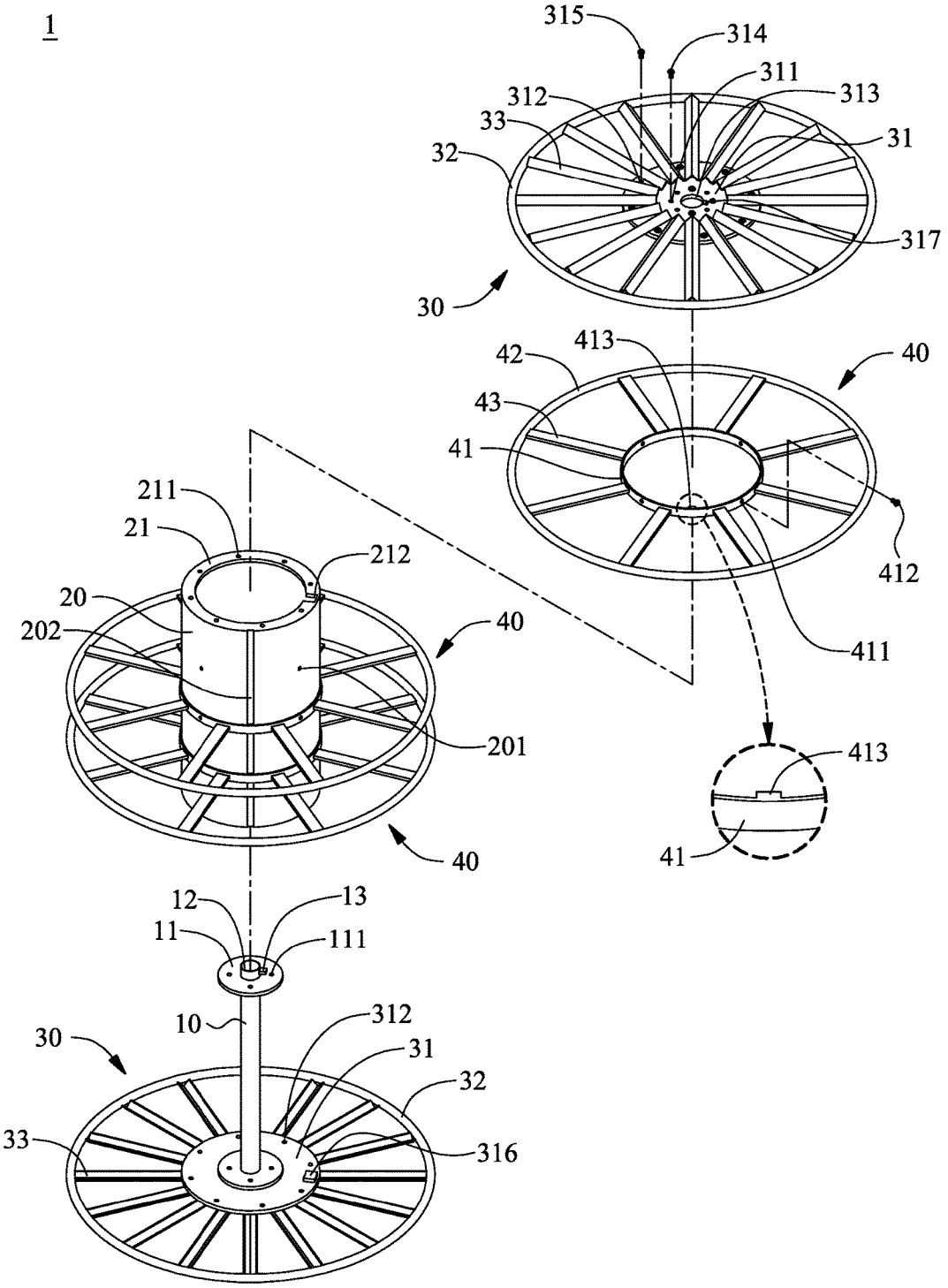
FIG. 4 is another exploded view of the composite reeling device according to the embodiment of the present invention.
Figure 5:
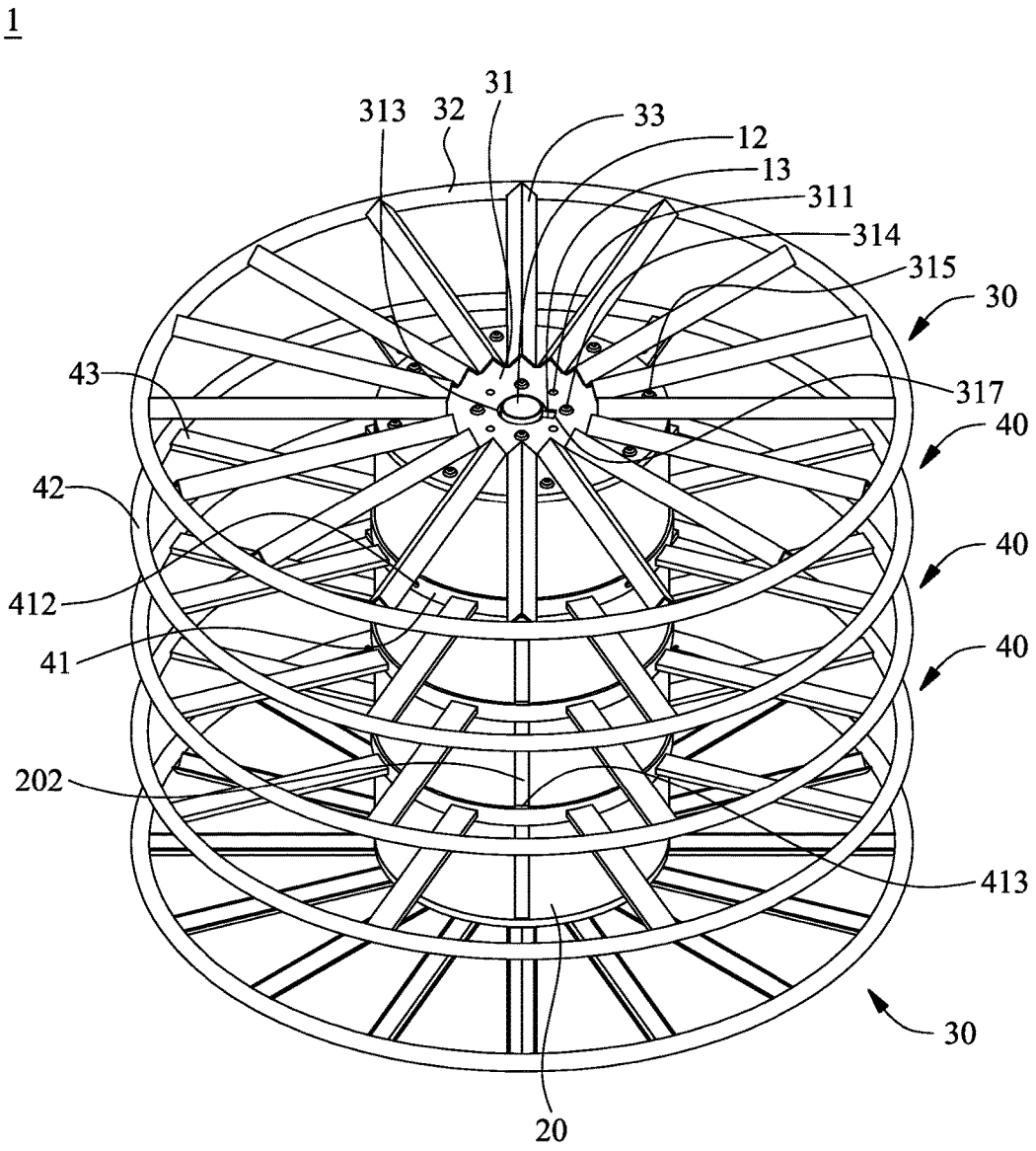
FIG. 5 is a perspective view of the composite reeling device also shown in FIG. 4 according to the embodiment of the present invention.

Referring to FIG. 4 and FIG. 5, in this embodiment, a protruding portion 12 and a positioning portion 13 are disposed at the two opposing ends of the shaft 10, respectively, and correspond in position to the fixing end plates 11, respectively. The fixing disks 31 each have a central hole 313 and a positioning opening 317. When each outer wheel frame 30 is mounted at one end of the shaft 10, the protruding portions 12 can penetrate the central holes 313, respectively, and thus the positioning portions 13 can be engaged with the positioning openings 317, respectively. In this embodiment, on the fixing end plates 11 at each end of the shaft, the protruding portions 12 are cylindrical and each have an axis which overlaps the axial line of the shaft 10, whereas the positioning portions 13 come in the form of bumps and are adjacent to the protruding portions 12. Furthermore, the innermost apertures 311 of the fixing disks 31 and the first mounting holes 111 of the fixing end plates 11 are configured in a manner to allow the innermost apertures 311 of the fixing disks 31 to correspond in position to the first mounting holes 111 of the fixing end plates 11, respectively, when the positioning portions 13 are engaged with the positioning openings 317, respectively. Hence, to mount the outer wheel frames 30 on one end of the shaft 10, the user only needs to pass the protruding portions 12 through the central holes 313 of the fixing disks 31, respectively, then allow the positioning portions 13 to get engaged with the positioning openings 317, respectively, and eventually align the innermost apertures 311 of the fixing disks 31 with the first mounting holes 111 of the fixing end plates 11, respectively.

In addition, in this embodiment, regarding the composite reeling device 1, the fixing flanges 21 of the sleeve 20 each have a positioning slot 212, whereas a positioning bump 316 is disposed on each of the fixing disks 31 corresponding in position to the fixing flanges 21. The positioning bumps 316 correspond in shape and position to the positioning slots 212 for the sake of engagement therebetween. In this embodiment, the positioning bumps 316 protrude from the fixing disks 31 toward the sleeve 20, respectively. Furthermore, the outermost apertures 312 of the fixing disks 31 and the second mounting holes 211 of the fixing flanges 21 are configured in a manner that the outermost apertures 312 of the fixing disks 31 correspond in position to the second mounting holes 211 of the fixing flanges 21, respectively, when the positioning bumps 316 get engaged with the positioning slots 212. Hence, the user mounts the outer wheel frames 30 on one end of the sleeve 20 to allow the positioning bumps 316 to get engaged with the positioning slots 21, respectively, such that the outermost apertures 312 on the fixing disks 31 are aligned with the second mounting holes 211 of the fixing flanges 21, respectively.

In this embodiment, regarding the composite reeling device 1, the sleeve 20 has a positioning guiding groove 202. The positioning guiding groove 202 is concavely formed on the outer cylindrical surface of the sleeve 20 and extends axially from one end of the sleeve 20 to the other end of the sleeve 20. A positioning sliding bump 413 which protrudes is disposed on each of the belts 41 of the inner wheel frames 40. The positioning sliding bumps 413 can slide along the positioning guiding groove 202. In this embodiment, to mount the inner wheel frames 40 at one end of the sleeve 20, the user slides the positioning sliding bumps 413 of the inner wheel frames 40 from one end of the sleeve 20 into the positioning guiding groove 202, and then slide the inner wheel frames 40 axially to adjust their positions so as to align the mounting holes 411 of the belts 41 with the third mounting holes 201 of the sleeve 20.

Figure 6:
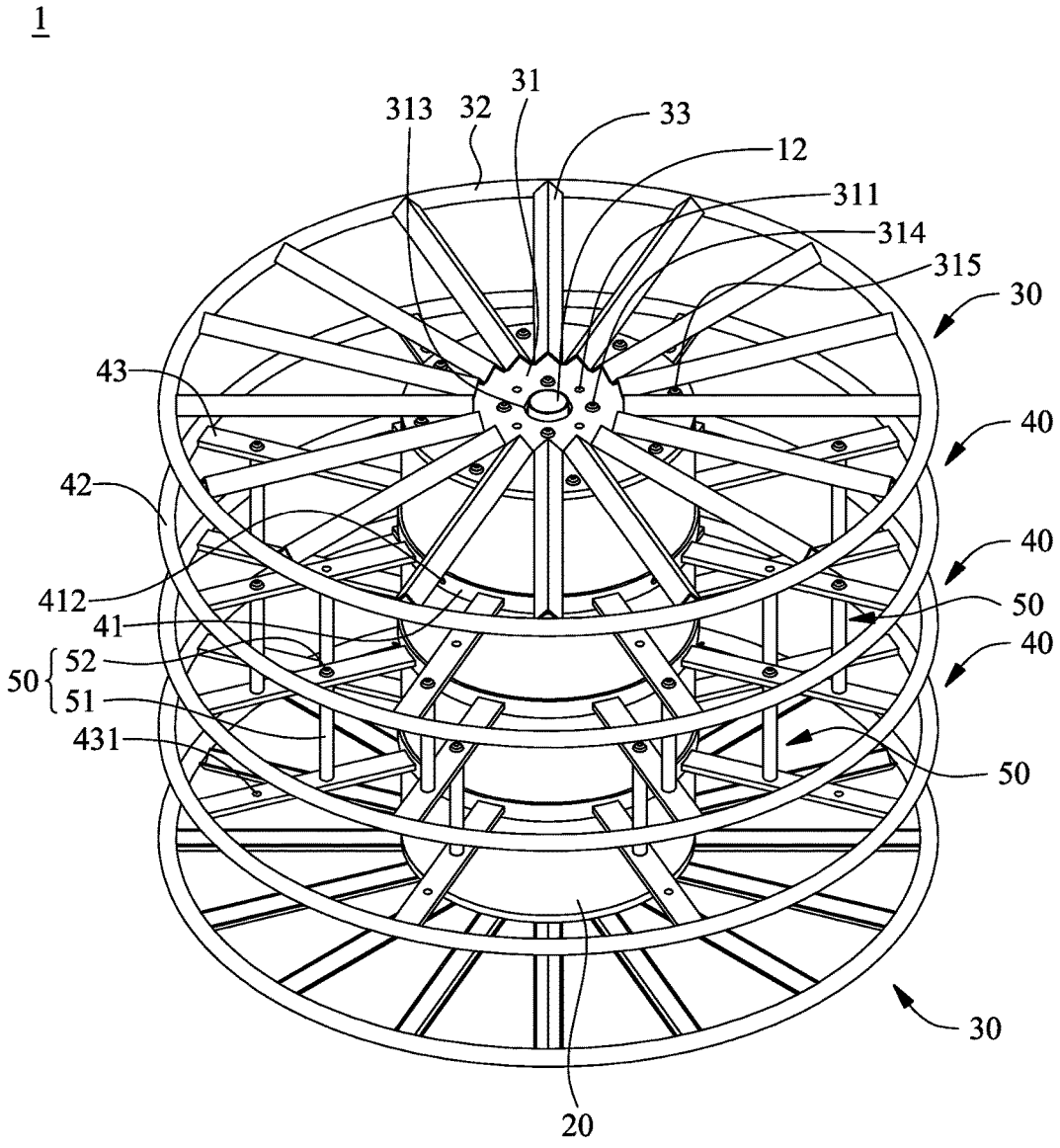
FIG. 6 is a schematic view of an adjustment unit mounted on the composite reeling device according to the embodiment of the present invention.

Referring to FIG. 6, in this embodiment, the composite reeling device 1 further comprises an adjustment unit 50 disposed on two adjacent inner wheel frames 40 to not only allow wires to be reeled but also adjust the perimeter of the windings of the wires according to the total length of the wires. For example, when the adjustment unit 50 is not mounted on the composite reeling device 1, the wires are wound around the sleeve 20, and in consequence the perimeter of the first winding of the wires equals the external perimeter of the sleeve 20. However, when the adjustment unit 50 is already mounted on the two adjacent inner wheel frames 40, the wires are wound around the adjustment unit 50, thereby increasing the perimeter of the first winding of the wires. In case with a small total length of the wires, it is feasible to mount the adjustment unit 50 on two adjacent inner wheel frames 40, such that the wires thus wound are close to the supporting ring 42 to enable easy access to the wires.

Figure 7:
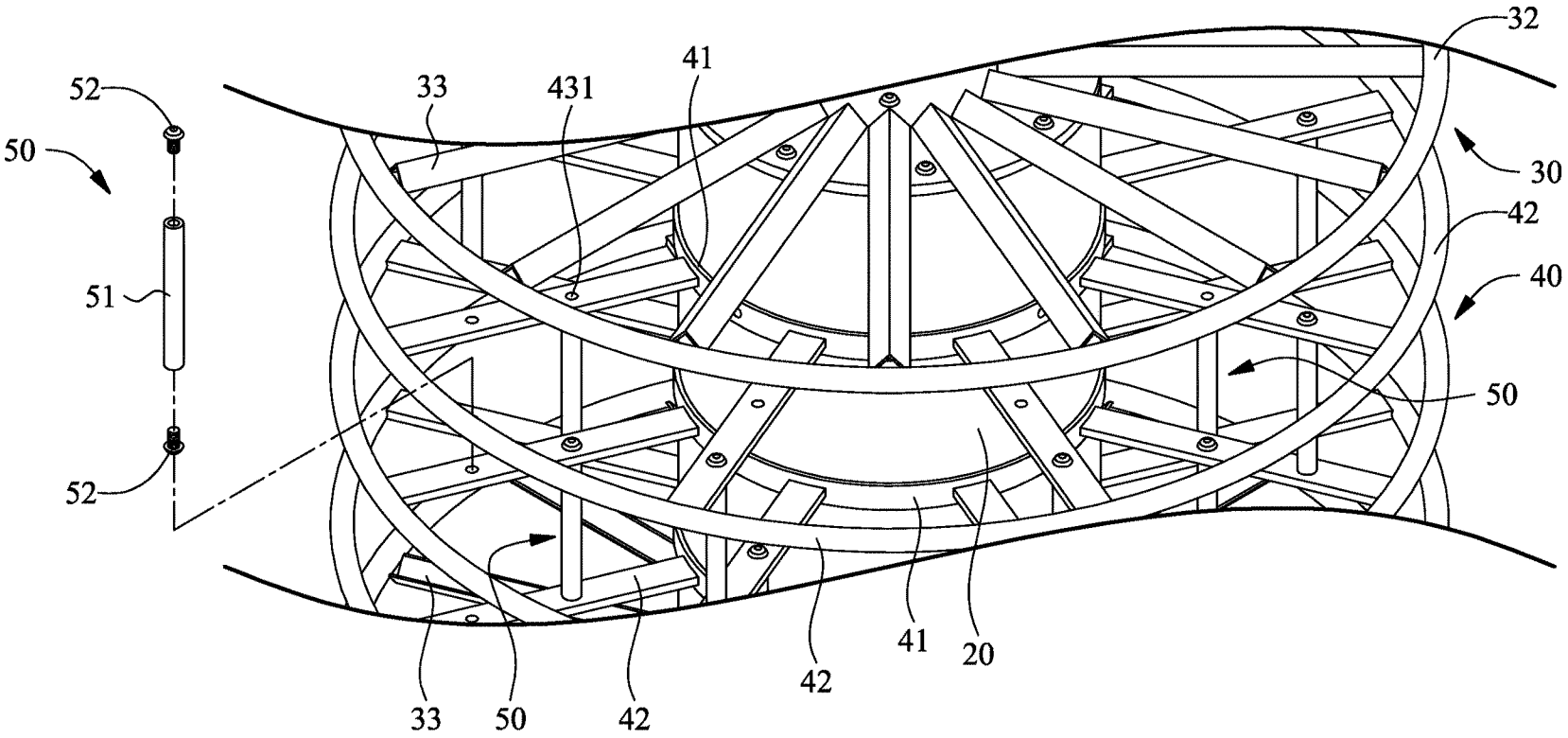
FIG. 7 is a partial exploded view of the composite reeling device with the adjustment unit mounted thereon according to the embodiment of the present invention.

In this embodiment, the adjustment unit 50 comprises a plurality of rods 51. The two ends of each rod 51 are coupled to spokes 43 of the two adjacent inner wheel frames 40. Referring to FIG. 7, each spoke 43 has a plurality of positioning holes 431 arranged lengthwise and neatly. The rods 51 are fastened to the positioning holes 431 with screws 52. Hence, depending on the intended perimeter of the windings of the wires, the rods 51 are selectively fastened to the intended positioning holes 431 of the spokes 43. For instance, the rods 51 fastened to the outermost positioning holes 431 achieve a larger perimeter of the first winding of the wires than the rods 51 fastened to the innermost positioning holes 431.

Therefore, in this embodiment, regarding the composite reeling device 1, a plurality of inner wheel frames 40 define a plurality of spaces for receiving the wires of different types to thereby enhance ease of use. In this embodiment, the composite reeling device 1 has some other advantages: the shaft, sleeve, outer wheel frames and inner wheel frames can be removed during a storage process and a transport process so as to be stored and stacked separately. Unlike the prior art, the present invention has important advantages as follows: storing more composite reeling devices in a space of a specific volume, increasing the storage space utilization rate, and using less vehicles required for transport. Furthermore, in this embodiment, the composite reeling device 1 is equipped with the adjustment unit 50 for adjusting the perimeter of the windings of the wires.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A composite reeling device, comprising:

a shaft having two opposing ends each provided with a fixing end plate;

a sleeve fitted around the shaft and having two opposing ends each provided with a fixing flange, wherein the fixing flanges correspond in position to the fixing end plates, respectively;

two outer wheel frames disposed at the two ends of the sleeve, respectively, and removably coupled to the fixing flanges and the fixing end plates, respectively; and a plurality of inner wheel frames each comprising a belt, a supporting ring and a plurality of spokes, wherein the spokes each have two ends connected to corresponding ones of the belts and corresponding ones of the supporting rings, such that the belts are fitted around the sleeve removably.

2. The composite reeling device of claim 1, further comprising an adjustment unit disposed at two adjacent inner wheel frames removably.

3. The composite reeling device of claim 2, wherein the adjustment unit comprises a plurality of rods each having two ends coupled to the spokes of two adjacent inner wheel frames removably.

4. The composite reeling device of claim 3, wherein the spokes each have a plurality of positioning holes arranged lengthwise and adapted to fasten the rods, respectively.

5. The composite reeling device of claim 4, wherein the outer wheel frames each comprise a fixing disk, an outer ring and a plurality of connection elements, with the connection elements connected to the fixing disks and the outer rings, and the fixing disks are removably coupled to the fixing flanges and the fixing end plates.

6. The composite reeling device of claim 5, wherein a protruding portion and a positioning portion are disposed at the two opposing ends of the shaft, respectively, and correspond in position to the fixing end plates, respectively, wherein the fixing disks each have a central hole and a positioning opening, wherein the protruding portions are penetratingly disposed in the central holes, respectively, and the positioning portions are engaged with the positioning openings, respectively.

7. The composite reeling device of claim 5, wherein the fixing flanges each have a positioning slot, and the fixing disks each have a positioning bump, wherein the positioning bumps correspond in shape and position to the positioning slots, respectively, to therefore enable engagement therebetween.

8. The composite reeling device of claim 5, wherein the sleeve has a positioning guiding groove extending axially from an end of the sleeve to another end of the sleeve, wherein a positioning sliding bump protrudes from each of the belts of the inner wheel frames and slides along the positioning guiding groove.

9. The composite reeling device of claim 5, wherein the inner wheel frames are arranged equidistantly.

10. The composite reeling device of claim 1, wherein the outer wheel frames each comprise a fixing disk, an outer ring and a plurality of connection elements, with the connection elements connected to the fixing disks and the outer rings, and the fixing disks are removably coupled to the fixing flanges and the fixing end plates.

11. The composite reeling device of claim 10, wherein a protruding portion and a positioning portion are disposed at the two opposing ends of the shaft, respectively, and correspond in position to the fixing end plates, respectively, wherein the fixing disks each have a central hole and a positioning opening, wherein the protruding portions are penetratingly disposed in the central holes, respectively, and the positioning portions are engaged with the positioning openings, respectively.

12. The composite reeling device of claim 10, wherein the fixing flanges each have a positioning slot, and the fixing disks each have a positioning bump, wherein the positioning bumps correspond in shape and position to the positioning slots, respectively, to therefore enable engagement therebetween.

13. The composite reeling device of claim 10, wherein the sleeve has a positioning guiding groove extending axially from an end of the sleeve to another end of the sleeve, wherein a positioning sliding bump protrudes from each of the belts of the inner wheel frames and slides along the positioning guiding groove.

14. The composite reeling device of claim 10, wherein the inner wheel frames are arranged equidistantly.

* * * * *